US007735679B2

(12) United States Patent
Liu et al.

(10) Patent No.: US 7,735,679 B2
(45) Date of Patent: Jun. 15, 2010

(54) REFILLABLE SHEET DISPENSER WITH FLEXIBILITY IN ACCOMMODATING STACKED NOTE SHEETS

(75) Inventors: Jen-Rong Liu, Kaohsiung Hsien (TW); Tsung-Tien Kuo, Kaohsiung Hsien (TW); Shu-Wei Ho, Kaohsiung Hsien (TW)

(73) Assignee: Taiwan Hopax Chems. Mfg. Co., Ltd., Kaohsiung Hsein (TW)

( * ) Notice: Subject to any disclaimer, the term of this patent is extended or adjusted under 35 U.S.C. 154(b) by 421 days.

(21) Appl. No.: 11/693,350

(22) Filed: Mar. 29, 2007

(65) Prior Publication Data

US 2008/0237254 A1 Oct. 2, 2008

(51) Int. Cl.
*B65D 83/00* (2006.01)

(52) U.S. Cl. ..... 221/63; 221/44; 221/64; 221/307; 221/309

(58) Field of Classification Search ..... 221/44, 221/63, 64, 307, 309
See application file for complete search history.

(56) References Cited

U.S. PATENT DOCUMENTS 1,205,892 A * 11/1916 Hecht ..... 221/37
2,242,737 A * 5/1941 Alfreds ..... 206/215
3,202,316 A * 8/1965 Silver ..... 221/59
4,416,392 A * 11/1983 Smith ..... 221/45
4,616,767 A * 10/1986 Seido ..... 221/58
4,653,666 A * 3/1987 Mertens ..... 221/45
5,755,356 A * 5/1998 Bastiaens et al. ..... 221/33
5,992,683 A * 11/1999 Sigl ..... 221/59

* cited by examiner

*Primary Examiner*—Gene Crawford
*Assistant Examiner*—Timothy R Waggoner
(74) *Attorney, Agent, or Firm*—Fox Rothschild, LLC; Robert J. Sacco

(57) ABSTRACT

A refillable sheet dispenser includes: a supporting base having two opposite first lateral sides and two opposite second lateral sides, each of which extends from one of the first lateral sides to the other of the first lateral sides; at least one stack of note sheets supported on the supporting base within the first and second lateral sides of the supporting base, each of the note sheets having two opposite lateral edges, each of which is disposed adjacent to a respective one of the second lateral sides of the supporting base and each of which extends between the first lateral sides of the supporting base; and a binding unit having a pair of elastically stretchable strips held tensely on the supporting base and extending from one of the second lateral sides to the other of the second lateral sides of the supporting base in such a manner to traverse the stack of the note sheets.

8 Claims, 10 Drawing Sheets

REFILLABLE SHEET DISPENSER WITH FLEXIBILITY IN ACCOMMODATING STACKED NOTE SHEETS

BACKGROUND OF THE INVENTION

1. Field of the Invention

This invention relates to a refillable sheet dispenser with flexibility in accommodating stacked note sheets, more particularly to a refillable sheet dispenser having a stack of note sheets bound to a supporting base using two elastically stretchable strips.

2. Description of the Related Art

As illustrated in FIGS. 1 and 2, U.S. Pat. No. 5,755,356 discloses a conventional sheet dispenser that includes a housing 12 having walls defining a chamber 124 in which at least one stack of note sheets 11 is positioned. The walls of the housing 12 include a bottom wall 121 and two opposite side walls 122, each of which has an extension 123 bent therefrom toward the stack of the note sheets 11. The extensions 123 of the side walls 122 define a sheet-access slot 125 therebetween for removal of an uppermost one of the note sheets 11.

The conventional sheet dispenser is disadvantageous in that since the size of the sheet-access slot 125 is not adjustable, different sizes of the sheet-access slot 125 are required for different sizes of the stack of the note sheets 11, and that since the height of the housing 12 is fixed, the stack of the note sheets 11 to be accommodated in the chamber 124 is limited to one having a particular thickness and size corresponding to the height and the shape of the housing 12.

SUMMARY OF THE INVENTION

The object of the present invention is to provide a refillable sheet dispenser that is flexible in accommodating different quantities of stacked note sheets and that can overcome the aforesaid drawbacks associated with the prior art.

According to this invention, there is provided a refillable sheet dispenser that comprises: a supporting base having two opposite first lateral sides and two opposite second lateral sides, each of which extends from one of the first lateral sides to the other of the first lateral sides; at least one stack of note sheets supported on the supporting base within the first and second lateral sides of the supporting base, each of the note sheets having two opposite lateral edges, each of which is disposed adjacent to a respective one of the second lateral sides of the supporting base and each of which extends between the first lateral sides of the supporting base, each of the note sheets further having an adhesive-applied segment provided with a repositionable pressure-sensitive adhesive, and a non-adhesive segment extending from the adhesive-applied segment, the adhesive-applied segment of each of the note sheets being attached releasably to the non-adhesive segment of an adjacent one of the note sheets; and a binding unit having a pair of elastically stretchable strips held tensely on the supporting base and extending from one of the second lateral sides to the other of the second lateral sides of the supporting base in such a manner to traverse the stack of the note sheets. The stretchable strips are spaced apart from each other to define a sheet-access slot therebetween for extension of the non-adhesive segment of an uppermost one of the note sheets therethrough.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
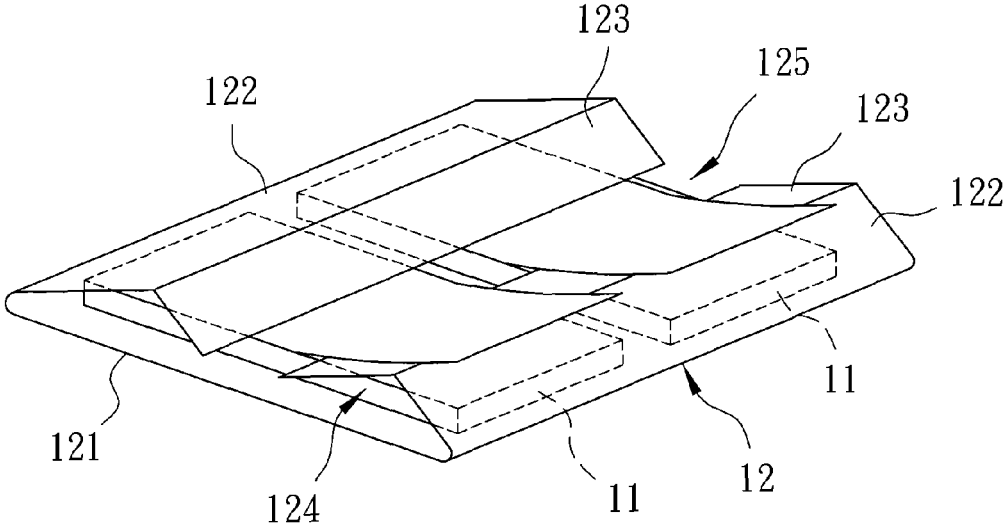
FIG. 1 PRIOR ART
FIG. 1 is a perspective view of a conventional refillable sheet dispenser.
Figure 2:
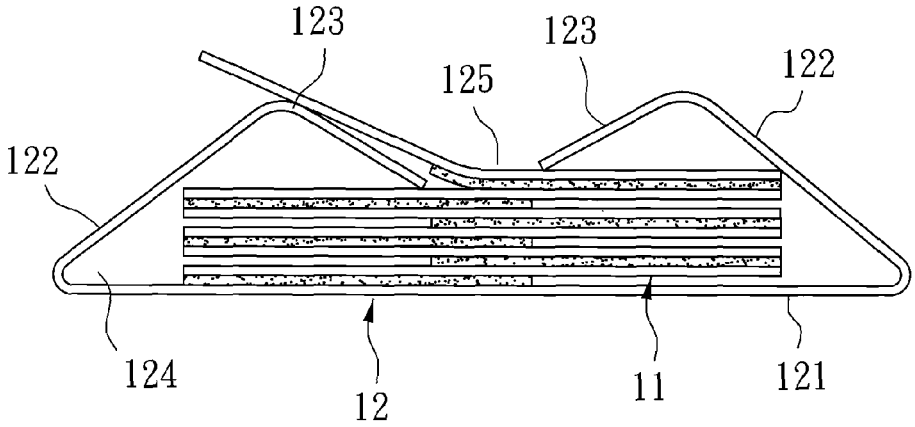
FIG. 2 PRIOR ART
FIG. 2 is a schematic side view of the conventional refillable sheet dispenser.

Before the present invention is described in greater detail with reference to the accompanying preferred embodiments, it should be noted herein that like elements are denoted by the same reference numerals throughout the disclosure.

Figure 3:
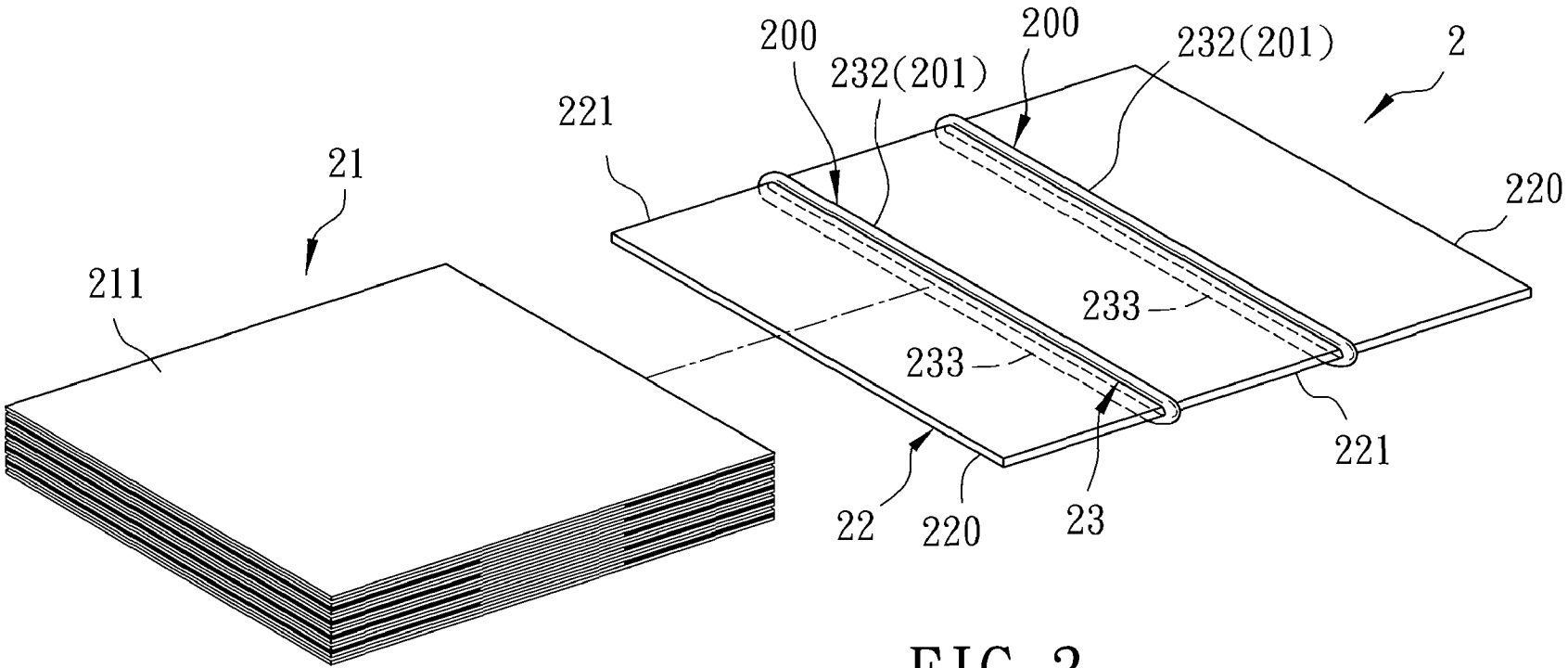
FIG. 3 is a partly exploded perspective view of the first preferred embodiment of a refillable sheet dispenser according to this invention.
Figure 4:
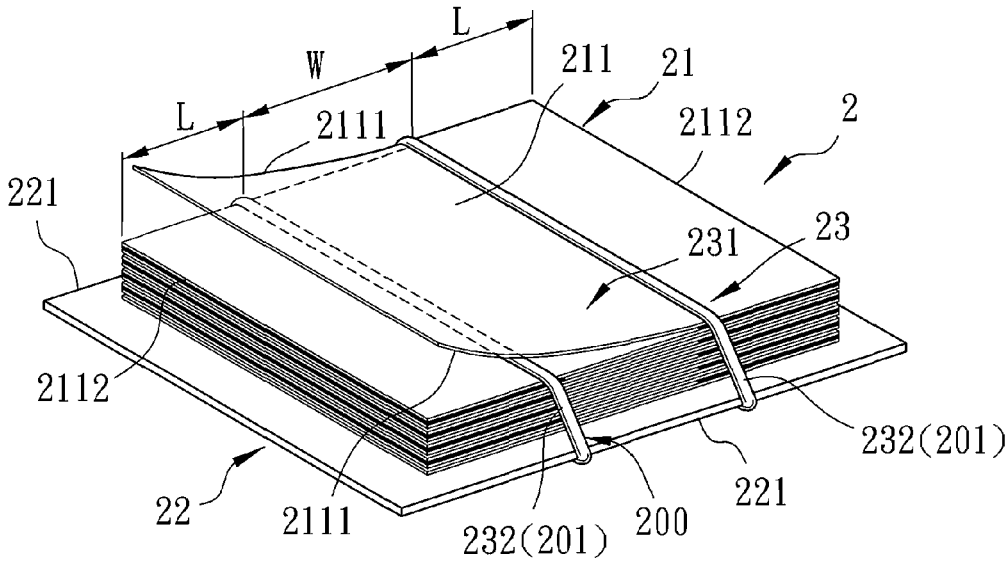
FIG. 4 is a an assembled perspective view of the first preferred embodiment.
Figure 5:
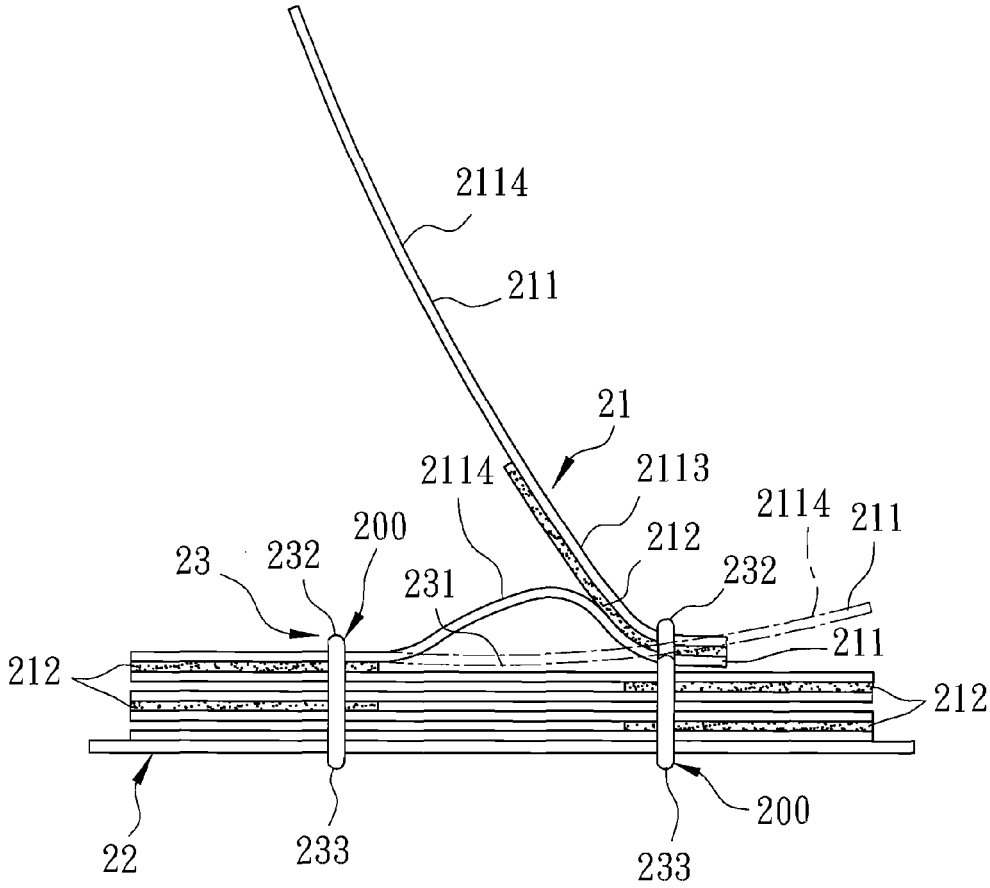
FIG. 5 is a schematic side view to illustrate how an uppermost note sheet is removed from a stack of note sheets in the first preferred embodiment.

FIGS. 3 to 5 illustrate the first preferred embodiment of a refillable sheet dispenser with flexibility in accommodating different quantities of stacked note sheets according to this invention. The refillable sheet dispenser 2 includes: a supporting base 22 having two opposite first lateral sides 220 and two opposite second lateral sides 221, each of which extends from one of the first lateral sides 220 to the other of the first lateral sides 220; a stack 21 of note sheets 211 supported on the supporting base 22 within the first and second lateral sides 220, 221 of the supporting base 22, each of the note sheets 211 having two opposite first lateral edges 2112 and two opposite second lateral edges 2111, each of which interconnects the first lateral edges 2112, each of which is disposed adjacent to a respective one of the second lateral sides 221 of the supporting base 22, and each of which extends between the first lateral sides 220 of the supporting base 22, each of the note sheets 211 further having an adhesive-applied segment 2113 provided with a repositionable pressure-sensitive adhesive 212, and a non-adhesive segment 2114 extending from the adhesive-applied segment 2113, the adhesive-applied segment 2113 of each of the note sheets 211 being attached releasaably to the non-adhesive segment 2114 of an adjacent one of the note sheets 211; and a binding unit 23 having a pair of elastically stretchable strips 232 held tensely on the supporting base 22 and extending from one of the second lateral sides 221 to the other of the second lateral sides 221 of the supporting base 22 in such a manner to traverse the stack 21 of the note sheets 211. The stretchable strips 232 are spaced apart from each other to define a sheet-access slot 231 therebetween for extension of the non-adhesive segment 2114 of an uppermost one of the note sheets 211 therethrough.

In this embodiment, the supporting base 22 is in the form of a flat panel. One of the stretchable strips 232 abuts resiliently against the second lateral sides 221 of the supporting base 22 and the second lateral edges 2111 of the uppermost one of the note sheets 211, and the other of the stretchable strips 232 abuts resiliently against the second lateral sides 221 of the supporting base 22 and the second lateral edges 2111 of another one of the note sheets 211 under the uppermost one of the note sheets 211.

The binding unit 23 includes two elastic loop members 200, each of which has a binding segment 201 defining a respective one of the stretchable strips 232, and a holding segment 233 interconnecting two ends of the binding segment 201 and disposed underneath the supporting base 22. Each of the loop members 200 is sleeved on an assembly of the supporting base 22 and the stack 21 of the note sheets 211.

Preferably, the width (W) (see FIG. 4) of the sheet-access slot 231 is greater than 1 mm, and the distance (L) between each of the stretchable strips 232 and an adjacent one of the first lateral edges 2112 of each of the note sheets 211 is greater than 4 mm.

Figure 6:
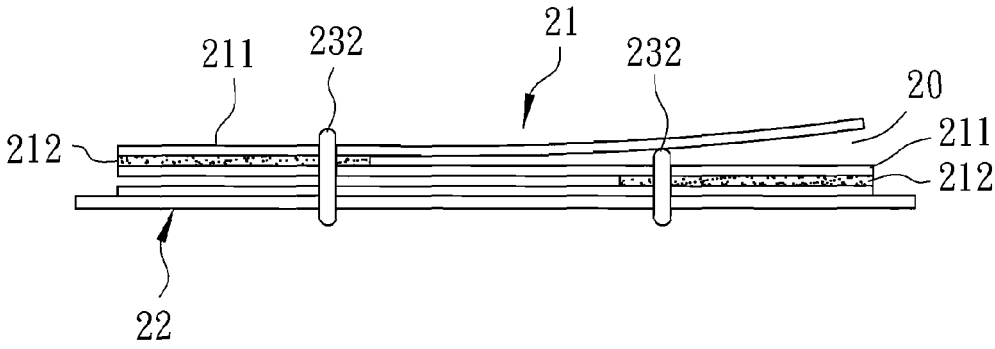
FIG. 6 is a schematic side view to illustrate a state where an elastically stretchable strip is elastically restored from an upper position shown in FIG. 5 to a lower position when the uppermost note sheet is removed from the stack of the note sheets in the first preferred embodiment.

FIGS. 5 and 6 illustrate how the uppermost one of the note sheets 211 is removed from the stack 21 of the note sheets 211 through the sheet-access slot 231, and how the non-adhesive segment 2114 of the next sheet 211 under the upper most one of the note sheets 211 is pulled to move through the sheet-access slot 231 during removal of the uppermost one of the note sheets 211 and is subsequently seated on an adjacent one of the stretchable strips 232 so as to be spaced apart from the next note sheet 211 by a gap 20. Said adjacent one of the stretchable strips 232 is stretched and is moved to an upper position (see FIG. 5) during removal of the uppermost one of the note sheets 211, and is subsequently restored elastically to a lower position (see FIG. 6) to abut resiliently against the next note sheet 211 upon removal of the uppermost one of the note sheets 211.

Figure 8:
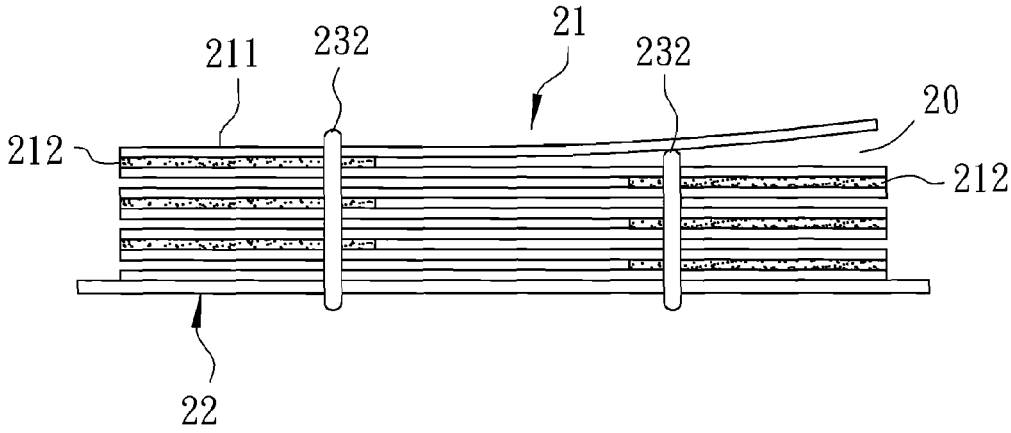
FIGS. 8 and 9 are schematic views to illustrate flexibility of the first preferred embodiment in accommodating thin and thick stacks of the note sheets.
Figure 9:
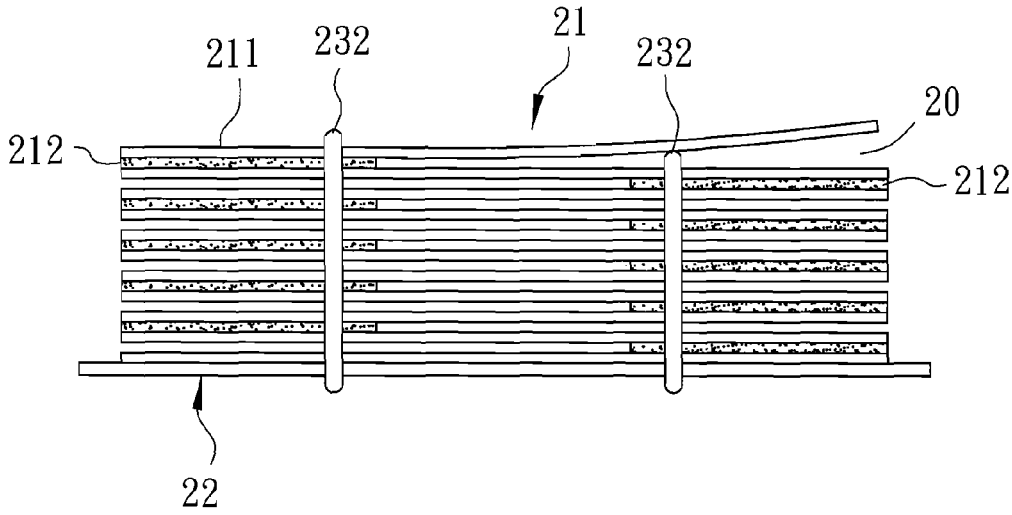

FIGS. 8 and 9 illustrate the flexibility of the refillable sheet dispenser 2 of the first preferred embodiment in accommodating thin and thick stacks 21 of the note sheets 211 by virtue of the elastically stretchable property of the stretchable strips 232. The stretchable strips 232 remain abutting resiliently against the uppermost one of the note sheets 211 when the thickness of the stack 21 of the note sheets 211 is gradually decreased during use. Since the stack 21 of the note sheets 211 is bound to the supporting base 22 by the loop members 200, replenishment of the note sheets 211, whether a thick or a thin stack, can be easily conducted.

Figure 7:
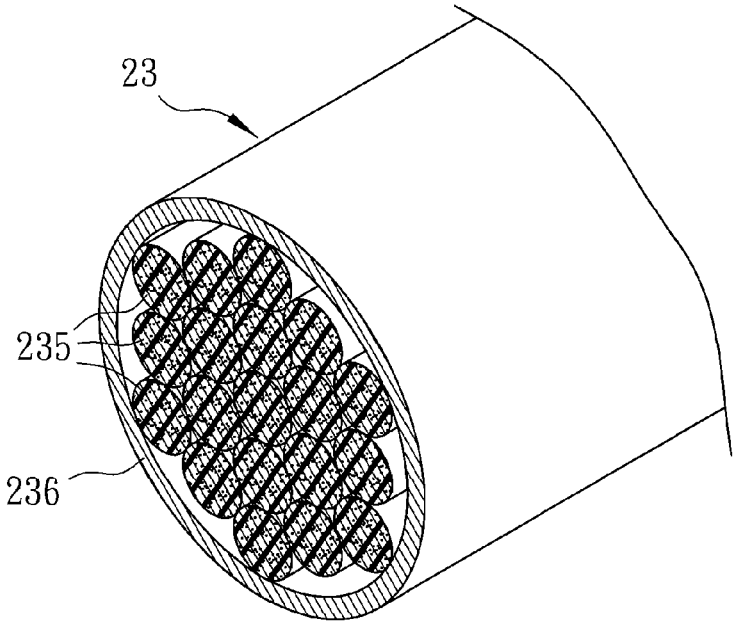
FIG. 7 is a fragmentary perspective sectional view of an elastically stretchable strip of the first preferred embodiment.

FIG. 7 illustrates a preferred structure of each of the loop members 200. Each of the loop members 200 has a core of a bundle of elastic filaments 235 and an elastic sheath 236 enclosing the core. Alternatively, the elastic filaments 235 can be intertwisted to form a strip, thereby dispensing with the elastic sheath 236, or each of the loop members 200 includes only one elastic filament 235 enclosed in the elastic sheath 236. Preferably, the filaments 235 and the sheath 236 are made from natural rubber.

Table 1 shows variation in the length of each of the loop members 200 for binding the stacks 21 of the note sheets 211 that differ in thickness, i.e., having different numbers of the note sheets 211, and that are each in the form of a 3"×3" paper. In addition, the size of the supporting base 22 is 86 mm×86 mm×2 mm.

TABLE 1

| | | | | | | | | |
|---|---|---|---|---|---|---|---|---|
| Numbers of the note sheets | 400 | 300 | 200 | 100 | 50 | 25 | 1 | 0 |
| Thickness of the stack, mm | 40 | 30 | 20 | 10 | 5 | 2.5 | 0.1 | 0 |
| The length of the loop member, mm | 236 | 216 | 196 | 176 | 166 | 161 | 157 | 156 |

The results of Table 1 show that the loop member(s) 200, when given a suitable elasticity, is capable of reducing correspondingly in length when the layer thickness of the stack(s) 21 of the note sheets 211 is gradually decreased, thereby constantly providing a suitable retaining force for retaining firmly the stack(s) 21 of the note sheets 211 on the supporting base 22 as well as for easy removal of the note sheets 211 from the supporting base 22.

Figure 10:
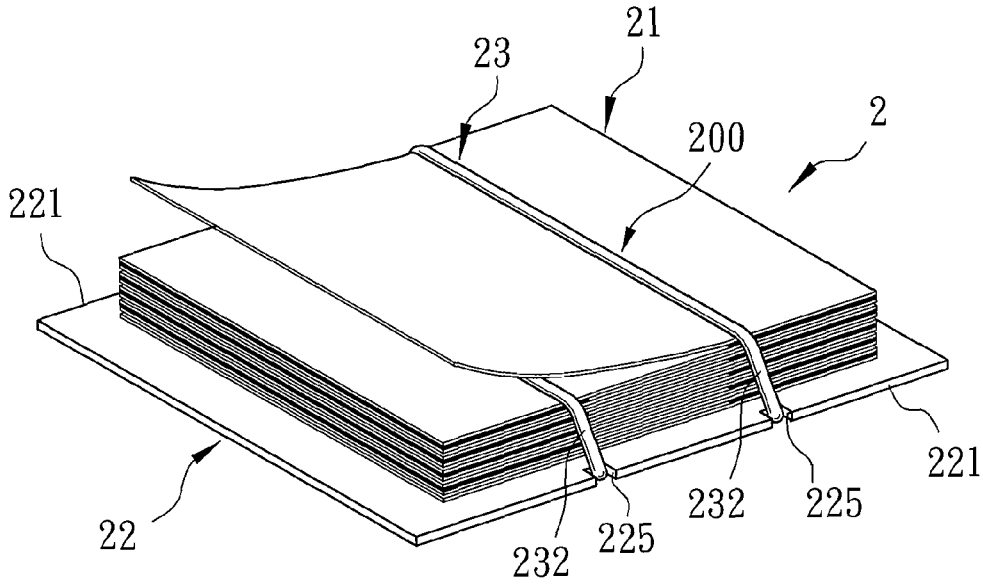
FIG. 10 is a perspective view of the second preferred embodiment of the refillable sheet dispenser according to this invention.

FIG. 10 illustrates the second preferred embodiment of the refillable sheet dispenser 2 according to this invention. The second preferred embodiment differs from the previous embodiment in that each of the second lateral sides 221 of the supporting base 22 is formed with two retaining notches 225. Each of the loop members 200 extends through a respective pair of the retaining notches 225 formed respectively in the second lateral sides 221 of the supporting base 22 and aligned with each other in a transverse direction relative to the second lateral sides 221 of the supporting base 22.

Figure 11:
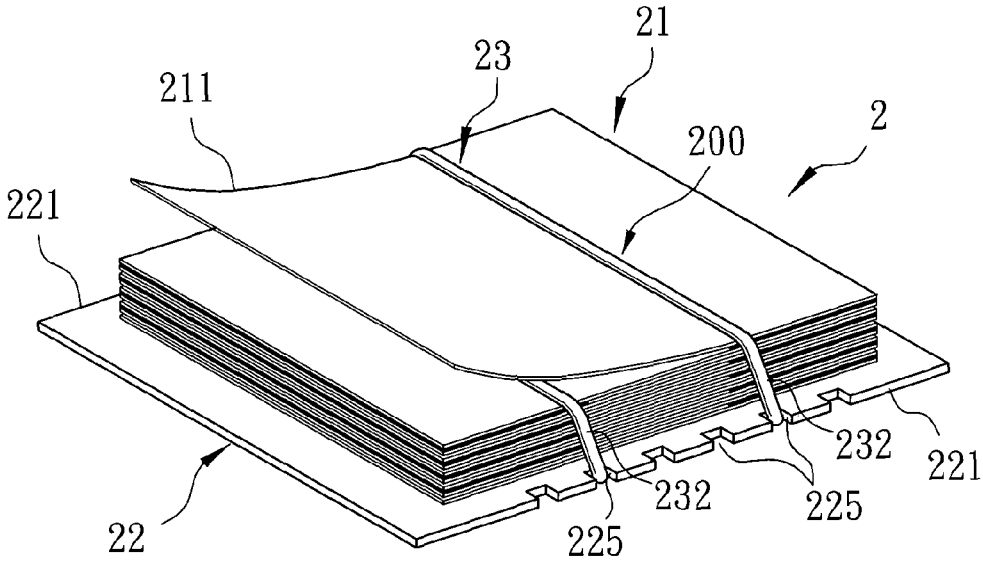
FIG. 11 is a perspective view of the third preferred embodiment of the refillable sheet dispenser according to this invention.

FIG. 11 illustrates the third preferred embodiment of the refillable sheet dispenser 2 according to this invention. The third preferred embodiment differs from the previous embodiments in that each of the second lateral sides 221 of the supporting base 22 is formed with a plurality of retaining notches 225. Each of the loop members 200 extends through a selected pair of the retaining notches 225 formed respectively in the second lateral sides 221 of the supporting base 22 and aligned with each other in a transverse direction relative to the second lateral sides 221 of the supporting base 22.

Figure 12:
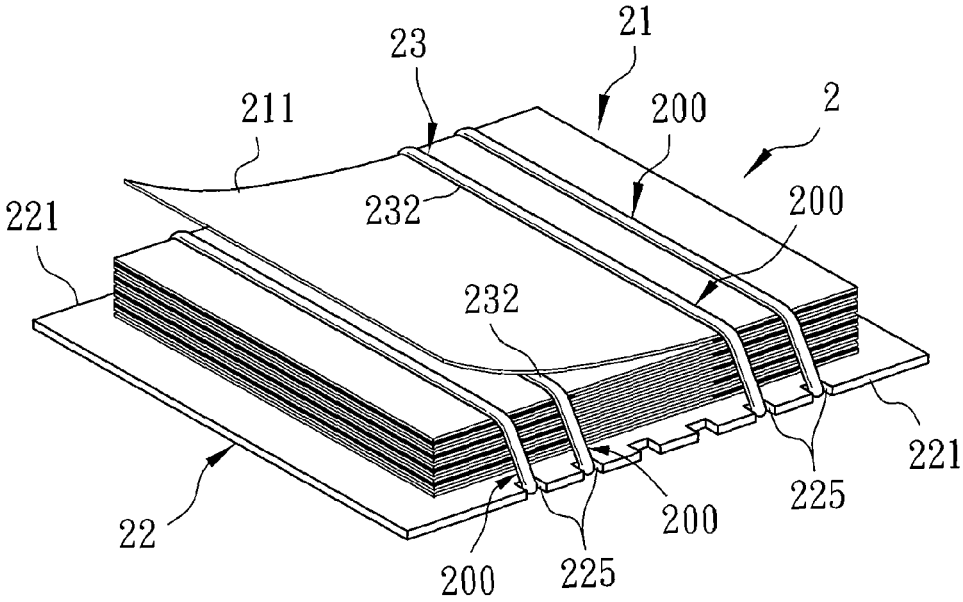
FIG. 12 is a perspective view of the fourth preferred embodiment of the refillable sheet dispenser according to this invention.

FIG. 12 illustrates the fourth preferred embodiment of the refillable sheet dispenser 2 according to this invention. The fourth preferred embodiment differs from the third preferred embodiment in that the binding unit 23 includes two pairs of first and second loop members 200 that are sleeved on the assembly of the supporting base 22 and the stack 21 of the note sheets 211. The first loop members 200 are disposed between the second loop members 200. Each of the first and second loop members 200 extends through a selected pair of the retaining notches 225 formed respectively in the second lateral sides 221 of the supporting base 22 and aligned with each other in a transverse direction relative to the second lateral sides 221 of the supporting base 22.

Figure 13:
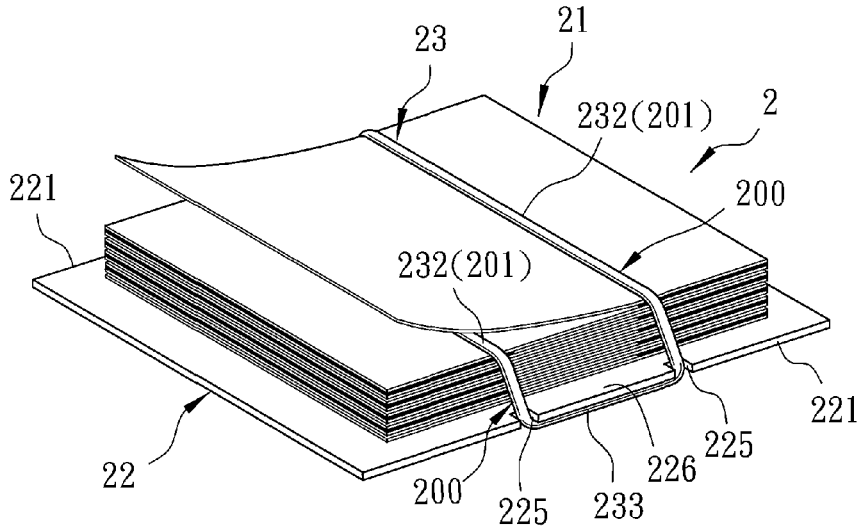
FIG. 13 is a perspective view of the fifth preferred embodiment of the refillable sheet dispenser according to this invention.
Figure 14:
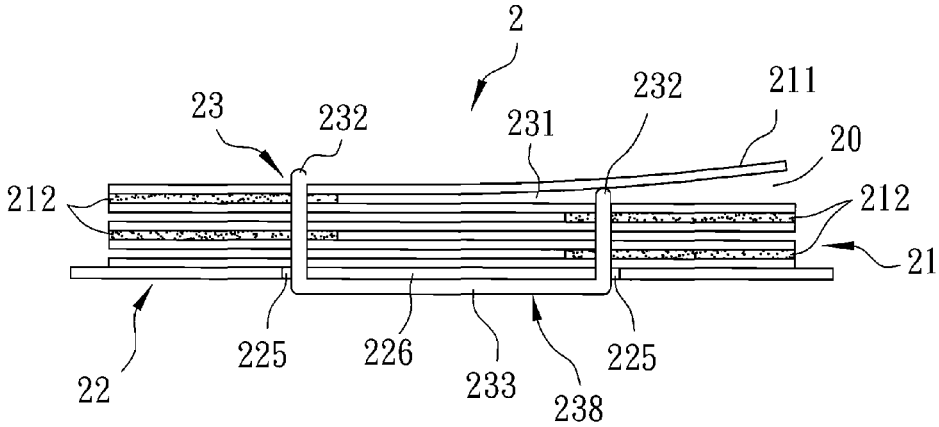
FIG. 14 is a schematic side view of the fifth preferred embodiment.

FIGS. 13 and 14 illustrate the fifth preferred embodiment of the refillable sheet dispenser 2 according to this invention. The fifth preferred embodiment differs from the previous embodiments in that each of the second lateral sides 221 of the supporting base 22 is formed with two retaining notches 225 separated by a retaining tongue 226. The binding unit 23 includes an elastic loop member 200 that has two binding segments 201, each of which defines a respective one of the stretchable strips 232. The elastic loop member 200 further has two holding segments 233, each of which interconnects and cooperates with the binding segments 201 to define a generally U-shaped end portion 238 (see FIG. 14) of the elastic loop member 200 that hooks at the retaining tongue 226 formed between the retaining notches 225 in a respective one of the second lateral sides 221 of the supporting base 22.

Figure 15:
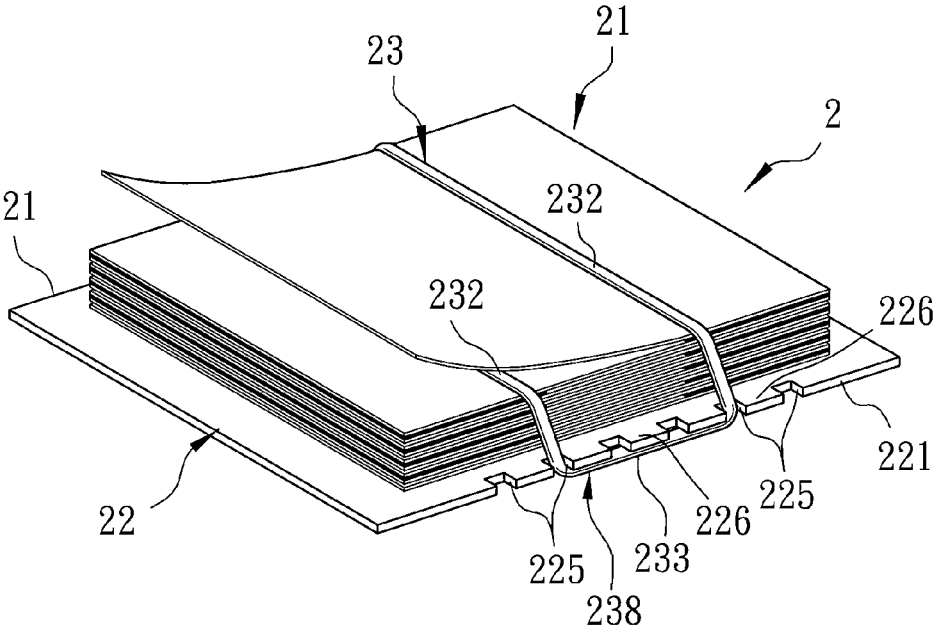
FIG. 15 is a perspective view of the sixth preferred embodiment of the refillable sheet dispenser according to this invention.

FIG. 15 illustrates the sixth preferred embodiment of the refillable sheet dispenser 2 according to this invention. The sixth preferred embodiment differs from the fifth preferred embodiment in that each of the second lateral sides 221 of the supporting base 22 is formed with a plurality of retaining notches 225. Each two adjacent ones of the retaining notches 225 are separated by a retaining tongue 226. Each generally U-shaped end portion 238 of the elastic loop member 200 hooks at selected ones of the retaining tongues 226 on a respective one of the second lateral sides 221 of the supporting base 22.

Figure 16:
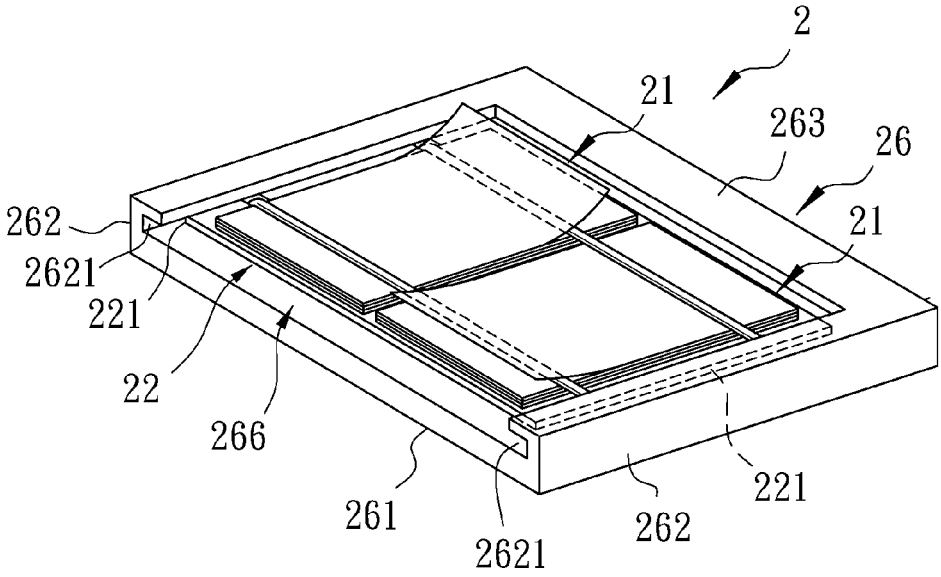
FIG. 16 is a perspective view of the seventh preferred embodiment of the refillable sheet dispenser according to this invention.

FIG. 16 illustrates the seventh preferred embodiment of the refillable sheet dispenser 2 according to this invention. The seventh preferred embodiment differs from the first preferred embodiment in that the refillable sheet dispenser 2 further includes a protective casing 26 defining an accommodating space 266 and having front and rear ends 261, 263 and two opposite inverted L-shaped side walls 262, each of which is formed with a retaining slot 2621 extending from the front end 261 to the rear end 263. The second lateral sides 221 of the supporting base 22 are inserted into the retaining slots 2621 in the side walls 262 of the protective casing 26, respectively. In this embodiment, two stack 21 of the note sheets 211 are received in the accommodating space 266 in the protective casing 26. The inverted L-shaped side walls 262 serve to prevent undesired removal of the assembly of the supporting base 22 and the stacks 21 of the note sheets 211 during removal of the uppermost ones of the note sheets 211.

Figure 17:
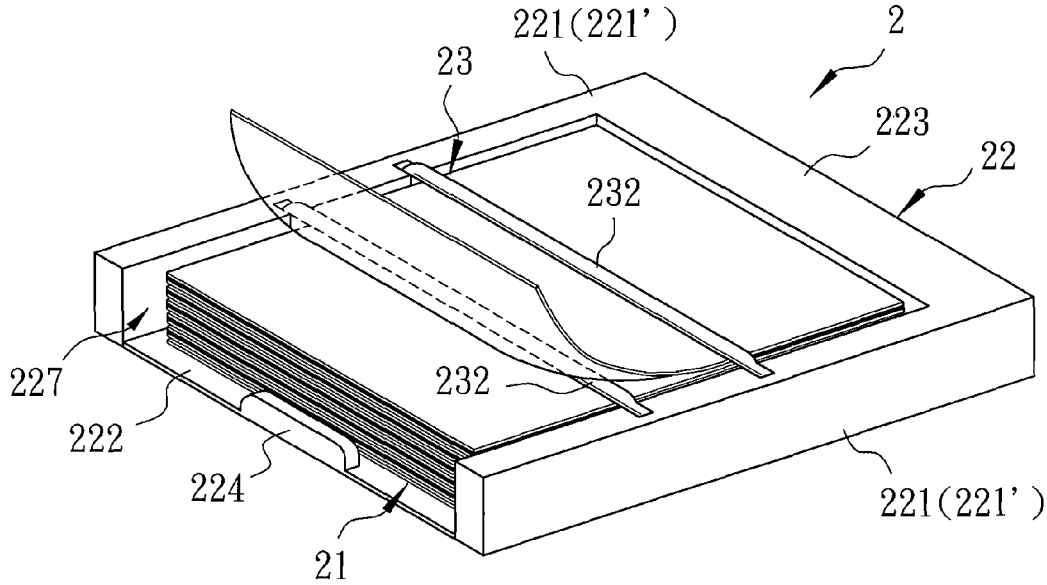
FIG. 17 is a perspective view of the eighth preferred embodiment of the refillable sheet dispenser according to this invention.

FIG. 17 illustrates the eighth preferred embodiment of the refillable sheet dispenser 2 according to this invention. The eighth preferred embodiment differs from the first preferred embodiment in that the supporting base 22 includes a bottom wall 222 and two opposite side walls 221' extending upright from the bottom wall 222 and defining respectively the second lateral sides 221 of the supporting base 22. Each of the stretchable strips 232 has two opposite ends that are respectively secured to the side walls 221' of the supporting base 22. In this embodiment, the supporting base 22 further includes a rear wall 223 extending upright from the bottom wall 222 and interconnecting the side walls 221', and a front curb 224 extending upright from the bottom wall 222 and spaced apart from the side walls 221'. The bottom wall 222, the side walls 221', the rear wall 223, and the front curb 224 cooperatively define an accommodating space 227 for receiving the stack 21 of the note sheets 211 therein.

Figure 18:
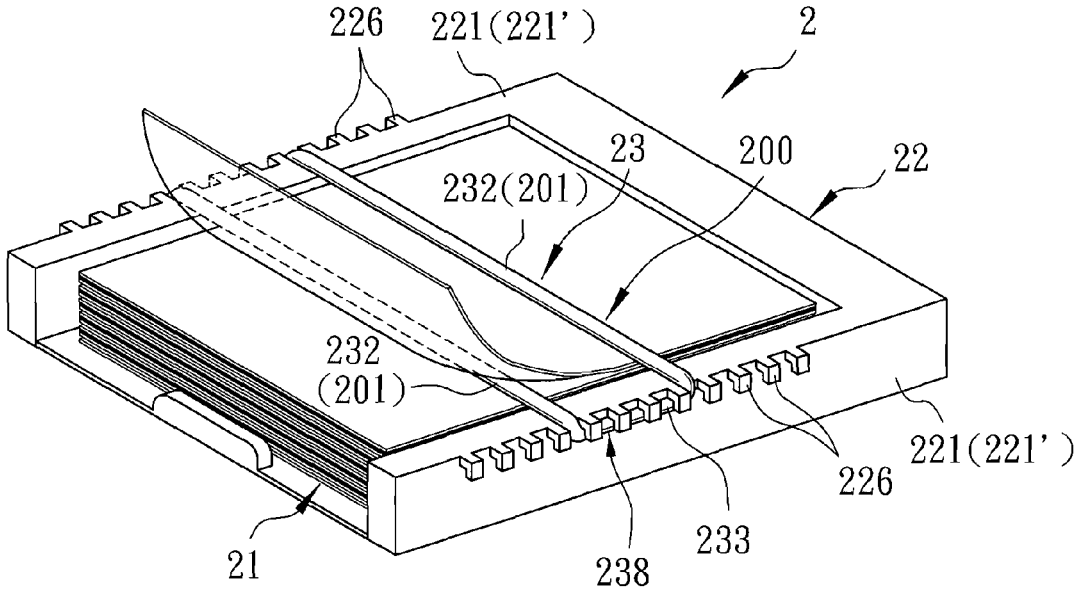
FIG. 18 is a perspective view of the ninth preferred embodiment of the refillable sheet dispenser according to this invention.

FIG. 18 illustrates the ninth preferred embodiment of the refillable sheet dispenser 2 according to this invention. The ninth preferred embodiment differs from the eighth preferred embodiment in that each of the side walls 221' is formed with a plurality of retaining tongues 226. The binding unit 23 includes an elastic loop member 200 that has two binding segments 201, each of which defines a respective one of the stretchable strips 232, and two holding segments 233, each of which interconnects and cooperates with the binding segments 201 to define a generally U-shaped end portion 238 of the elastic loop member 200 that hooks at selected ones of the retaining tongues 226 on a respective one of the side walls 221' of the supporting base 22.

With the inclusion of the binding unit 23 in the refillable sheet dispenser 2 of this invention, the aforesaid drawbacks associated with the prior art can be eliminated. In addition, the binding unit 23 of this invention has a relatively simple structure and can be manufactured at a lower cost as compared to the aforesaid conventional sheet dispenser.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A refillable sheet dispenser, comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasably to said non-adhesive segment of an adjacent one of said note sheets; and a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough;

wherein said supporting base is in the form of a flat panel, one of said stretchable strips abutting resiliently against said second lateral sides of said supporting base and said lateral edges of the uppermost one of said note sheets, the other of said stretchable strips abutting against said second lateral sides of said supporting base and said lateral edges of another one of said note sheets under the uppermost one of said note sheets, and wherein each of said second lateral sides of said supporting base is formed with two retaining notches separated by a retaining tongue, said binding unit including an elastic loop member that has two binding segments, each of which defines a respective one of said stretchable strips, said elastic loop member further having two holding segments, each of which interconnects and cooperates with said binding segments to define a generally U-shaped end portion of said elastic loop member that hooks at said retaining tongue formed between said retaining notches in a respective one of said second lateral sides of said supporting base.

2. A refillable sheet dispenser, comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasable to said non-adhesive segment of an adjacent one of said note sheets; and a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough;

wherein said supporting base is in the form of a flat panel, one of said stretchable strips abutting resiliently against said second lateral sides of said supporting base and said lateral edges of the uppermost one of said note sheets, the other of said stretchable strips abutting against said second lateral sides of said supporting base and said lateral edges of another one of said note sheets under the uppermost one of said note sheets, and wherein each of said second lateral sides of said supporting base is formed with a plurality of retaining notches, each two adjacent ones of said retaining notches being separated by a retaining tongue, said binding unit including an elastic loop member that has two binding segments, each of which defines a respective one of said stretchable strips, said elastic loop member further having two holding segments, each of which interconnects and cooperates with said binding segments to define a generally U-shaped end portion of said elastic loop member that hooks at selected ones of said retaining tongues on a respective one of said second lateral sides of said supporting base.

3. A refillable sheet dispenser, comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasably to said non-adhesive segment of an adjacent one of said note sheets;

a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough; and a protective casing defining an accommodating space and having front and rear ends and two opposite side walls, each of which is formed with a slot extending from said front end to said rear end, said second lateral sides of said supporting base being inserted into said slots in said side walls of said protective casing, said stack of said note sheets being received in said accommodating space in said protective casing;

wherein said supporting base is in the form of a flat panel, one of said stretchable strips abutting resiliently against said second lateral sides of said supporting base and said lateral edges of the uppermost one of said note sheets, the other of said stretchable strips abutting against said second lateral sides of said supporting base and said lateral edges of another one of said note sheets under the uppermost one of said note sheets.

4. A refillable sheet dispenser comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasably to said non-adhesive segment of an adjacent one of said note sheets; and a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough, wherein said supporting base includes a bottom wall and two opposite side walls extending upright from said bottom wall and defining respectively said second lateral sides of said supporting base, each of said stretchable strips having two opposite ends that are respectively secured to said side walls of said supporting base, wherein said supporting base further includes a rear wall extending upright from said bottom wall and interconnecting said side walls, and a front curb extending upright from said bottom wall and spaced apart from said side walls.

5. The refillable sheet dispenser of claim 4, wherein each of said stretchable strips has a core of a bundle of elastic filaments and an elastic sheath enclosing said core.

6. A refillable sheet dispenser, comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasably to said non-adhesive segment of an adjacent one of said note sheets; and a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough;

wherein said supporting base is in the form of a flat panel, one of said stretchable strips abutting resiliently against said second lateral sides of said supporting base and said lateral edges of the uppermost one of said note sheets, the other of said stretchable strips abutting against said second lateral sides of said supporting base and said lateral edges of another one of said note sheets under the uppermost one of said note sheets, and wherein said supporting base includes a bottom wall and two opposite side walls extending upright from said bottom wall and defining respectively said second lateral sides of said supporting base, each of said side walls being formed with a plurality of retaining tongues, said binding unit including an elastic loop member that has two binding segments, each of which defines a respective one of said stretchable strips, said elastic loop member further having two holding segments, each of which interconnects and cooperates with said binding segments to define a generally U-shaped end portion of said elastic loop member that hooks at selected ones of said retaining tongues on a respective one of said side walls of said supporting base.

7. A refillable sheet dispenser comprising:

a supporting base having two opposite first lateral sides and two opposite second lateral sides, each of which extends from one of said first lateral sides to the other of said first lateral sides;

at least one stack of note sheets supported on said supporting base within said first and second lateral sides of said supporting base, each of said note sheets having two opposite lateral edges, each of which is disposed adjacent to a respective one of said second lateral sides of said supporting base and each of which extends between said first lateral sides of said supporting base, each of said note sheets further having an adhesive-applied segment provided with a repositionable pressure-sensitive adhesive, and a non-adhesive segment extending from said adhesive-applied segment, said adhesive-applied segment of each of said note sheets being attached releasably to said non-adhesive segment of an adjacent one of said note sheets; and a binding unit having a pair of elastically stretchable strips held tensely on said supporting base and extending from one of said second lateral sides to the other of said second lateral sides of said supporting base in such a manner to traverse said stack of said note sheets, said stretchable strips being spaced apart from each other to define a sheet-access slot therebetween for extension of said non-adhesive segment of an uppermost one of said note sheets therethrough, wherein said supporting base includes a bottom wall and two opposite side walls extending upright from said bottom wall and defining respectively said second lateral sides of said supporting base, each of said side walls being formed with a plurality of retaining tongues, said binding unit including an elastic loop member that has two binding segments, each of which defines a respective one of said stretchable strips, said elastic loop member further having two holding segments, each of which interconnects and cooperates with said binding segments to define a generally U-shaped end portion of said elastic loop member that hooks at selected ones of said retaining tongues on a respective one of said side walls of said supporting base.

8. The refillable sheet dispenser of claim 7, wherein each of said stretchable strips has a core of a bundle of elastic filaments and an elastic sheath enclosing said core.

* * * * *